US009721580B2

(12) United States Patent
Skoglund et al.

(10) Patent No.: US 9,721,580 B2
(45) Date of Patent: Aug. 1, 2017

(54) SITUATION DEPENDENT TRANSIENT SUPPRESSION

(71) Applicant: GOOGLE INC., Mountain View, CA (US)

(72) Inventors: Jan Skoglund, Mountain View, CA (US); Alejandro Luebs, Stockholm (SE)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/230,404

(22) Filed: Mar. 31, 2014

(65) Prior Publication Data

US 2015/0279386 A1 Oct. 1, 2015

(51) Int. Cl.

| | |
|---|---|
| ***G10L 21/0208*** | (2013.01) |
| ***G10L 25/84*** | (2013.01) |
| ***G10L 25/90*** | (2013.01) |
| *G10L 25/78* | (2013.01) |

(52) U.S. Cl.

CPC ..... *G10L 21/0208* (2013.01); *G10L 25/84* (2013.01); *G10L 25/90* (2013.01); *G10L 25/78* (2013.01)

(58) Field of Classification Search

CPC combination set(s) only.
See application file for complete search history.

(56) References Cited

U.S. PATENT DOCUMENTS 5,414,796 A * 5/1995 Jacobs ..... G10L 19/005 704/201
6,266,633 B1 * 7/2001 Higgins ..... G10L 21/0208 704/224
6,366,880 B1 * 4/2002 Ashley ..... G10L 21/0208 379/392.01
6,426,983 B1 * 7/2002 Rakib ..... H04B 1/7102 375/346
7,353,169 B1 4/2008 Goodwin et al.

(Continued)

OTHER PUBLICATIONS

Arehart (Arehart, Kathryn Hoberg, et al. "Evaluation of an auditory masked threshold noise suppression algorithm in normal-hearing and hearing-impaired listeners." Speech Communication 40.4 (2003): 575-592.).*

(Continued)

*Primary Examiner* — Pierre-Louis Desir
*Assistant Examiner* — Jonathan Kim
(74) *Attorney, Agent, or Firm* — Brake Hughes Bellermann LLP

(57) ABSTRACT

Provided are methods and systems for providing situation-dependent transient noise suppression for audio signals. Different strategies (e.g., levels of aggressiveness) of transient suppression and signal restoration are applied to audio signals associated with participants in a video/audio conference depending on whether or not each participant is speaking (e.g., whether a voiced segment or an unvoiced/non-speech segment of audio is present). If no participants are speaking or there is an unvoiced/non-speech sound present, a more aggressive strategy for transient suppression and signal restoration is utilized. On the other hand, where voiced audio is detected (e.g., a participant is speaking), the methods and systems apply a softer, less aggressive suppression and restoration process.

18 Claims, 6 Drawing Sheets

(56) References Cited

U.S. PATENT DOCUMENTS 7,451,082 B2 * 11/2008 Gong ..... G10L 21/0208 704/210
7,551,965 B2 * 6/2009 Bange ..... H04B 1/1036 607/60
8,019,089 B2 9/2011 Seltzer et al.
8,213,635 B2 7/2012 Li et al.
8,239,194 B1 * 8/2012 Paniconi ..... G10L 21/0216 381/71.1
8,265,292 B2 9/2012 Leichter
8,271,279 B2 * 9/2012 Hetherington ..... G10L 21/0216 704/205
8,321,206 B2 11/2012 Goodwin et al.
8,326,621 B2 * 12/2012 Hetherington ..... 704/205
8,411,874 B2 4/2013 Leichter
8,416,964 B2 * 4/2013 Bryson ..... H04B 1/3822 381/94.1
8,538,751 B2 9/2013 Nakadai et al.
8,600,073 B2 * 12/2013 Sun ..... G10L 21/0208 381/94.1
8,612,222 B2 * 12/2013 Hetherington ..... G10L 21/0216 704/205
8,712,762 B2 * 4/2014 Dubbelboer ..... G10L 21/0208 704/205
8,972,270 B2 * 3/2015 Oh ..... G10L 19/032 704/200
2001/0021905 A1 * 9/2001 Burnett ..... A61B 5/0507 704/233
2002/0094044 A1 * 7/2002 Kolze ..... H04B 1/1027 375/346
2002/0126778 A1 * 9/2002 Ojard ..... H04B 1/1036 375/346
2003/0023430 A1 * 1/2003 Wang ..... G10L 19/26 704/226
2004/0167777 A1 * 8/2004 Hetherington ..... G10L 21/0208 704/226
2005/0108004 A1 * 5/2005 Otani ..... G10L 25/78 704/205
2005/0114128 A1 * 5/2005 Hetherington ..... G10L 21/0208 704/233
2005/0278172 A1 * 12/2005 Koishida ..... G10L 21/0208 704/227
2006/0025992 A1 * 2/2006 Oh ..... G11B 20/24 704/226
2006/0064301 A1 * 3/2006 Aguilar ..... G10L 19/093 704/233
2006/0100868 A1 * 5/2006 Hetherington ..... G10L 21/0208 704/226
2006/0116873 A1 * 6/2006 Hetherington ..... G10L 21/0208 704/226
2006/0251268 A1 * 11/2006 Hetherington ..... G10L 21/0208 381/94.1
2006/0293882 A1 * 12/2006 Giesbrecht ..... G10L 15/065 704/204
2007/0078649 A1 * 4/2007 Hetherington ..... G10L 21/0216 704/226
2008/0015821 A1 * 1/2008 Roushall ..... H01J 49/0036 702/191
2008/0019538 A1 * 1/2008 Kushner ..... A62B 18/08 381/94.1
2008/0279366 A1 11/2008 Lindbergh
2008/0298601 A1 * 12/2008 Rahbar ..... H04M 9/082 381/66
2010/0088092 A1 4/2010 Bruhn
2011/0033055 A1 * 2/2011 Low ..... G10L 21/0208 381/56
2011/0103615 A1 * 5/2011 Sun ..... G10L 21/0208 381/94.3
2011/0112831 A1 5/2011 Sorensen et al.
2011/0125490 A1 * 5/2011 Furuta ..... G10L 21/0232 704/205
2011/0142257 A1 6/2011 Goodwin et al.
2011/0243123 A1 10/2011 Munoz-Bustamante et al.
2011/0288858 A1 * 11/2011 Gay ..... G10L 21/028 704/226
2011/0320211 A1 * 12/2011 Liu ..... G10L 19/0208 704/500
2012/0035921 A1 * 2/2012 Li ..... G10L 21/0208 704/226
2012/0076315 A1 * 3/2012 Hetherington ..... 381/71.4
2012/0148057 A1 * 6/2012 Beerends ..... G10L 25/69 381/56
2012/0321095 A1 * 12/2012 Hetherington ..... G10L 21/0216 381/56
2013/0191118 A1 * 7/2013 Makino ..... G10L 21/0232 704/226
2014/0244247 A1 * 8/2014 Christensen ..... G10L 25/48 704/226
2014/0278389 A1 * 9/2014 Zurek ..... G10L 15/20 704/231
2014/0337018 A1 * 11/2014 Samuel ..... H03G 3/32 704/205
2015/0081283 A1 * 3/2015 Sun ..... G10L 25/18 704/205
2015/0081285 A1 * 3/2015 Sohn ..... G10L 21/02 704/219
2015/0106087 A1 * 4/2015 Newman ..... G10L 25/78 704/233
2015/0139433 A1 * 5/2015 Funakoshi ..... H04R 3/04 381/71.1

OTHER PUBLICATIONS

McAulay (McAulay, Robert J., and Marilyn L. Malpass. "Speech enhancement using a soft-decision noise suppression filter." Acoustics, Speech and Signal Processing, IEEE Transactions on 28.2 (1980): 137-145.).*
Chandra, C. et al., "An Efficient Method for the Removal of Impulse Noise From Speech and Audio Signals", IEEE International Symposium on Circuits and Systems,vol. 4, May 1998, pp. 206-208.
Fevotte C. et al., "Sparse Linear Regression in Unions of Bases via Bayesian Variable Selection", IEEE Signal Processing Letters, vol. 13, No. 7, Jul. 2006, pp. 441-444.
Fevotte C. et al., "Sparse Linear Regression With Structured Priors and Application to Denoising of Musical Audio", IEEE Transactions on Audio, Speech, and Language Processing, vol. 16, No. 1, Jan. 2008, pp. 174-185.
Godsill, S. J. et al., "Statistical Reconstruction and Analysis of Autoregressive Signals in Impulsive Noise Using the Gibbs Sampler", IEEE Transactions on Speech and Audio Processing, vol. 6, No. 4, Jul. 1998, pp. 352-372.
Murphy et al., "Joint Bayesian Removal of Impulse and Background Noise", IEEE International Conference on Acoustics, Speech and Signal Processing (ICASSP), May 2011, pp. 261-264.
Nongpiur, R.C., "Impulse Noise Removal in Speech Using Wavelets", IEEE International Conference on Acoustics, Speech and Signal Processing (ICASSP), Mar. 2008, pp. 1593-1596.
Subramanya, A. et al. "Automatic Removal of Typed Keystrokes from Speech Signals", Interspeech, 2006, pp. 261-264.
Sugiyama, A., "Single-Channel Impact-Noise Suppression With No Auxiliary Information for Its Detection", IEEE Workshop on Applications of Signal Processing to Audio and Acoustics, Oct. 21-24 2007, pp. 127-130.
Vaseghi, S. V., "Detection and suppression of impulsive noise in speech communication systems", IEEE Proceedings, vol. 137, Pt. 1, No. 1, Feb. 1990.
Wolfe, P.J. et al., "Bayesian Estimation of Time-Frequency Coefficients for Audio Signal Enhancement", in Advances in Neural Information Processing Systems, The MIT Press, 2003. Cambridge, MA.
Wolfe, P.J. et al., "Bayesian variable selection and regularization for time-frequency estimation", J.R. Statist. Soc. B, (2004), vol. 66, Part 3, pp. 575-589.
International Search Report and Written Opinion received for PCT Patent Application No. PCT/US2015/023500, mailed on Sep. 10, 2015, 9 pages.

(56) References Cited

OTHER PUBLICATIONS

International Preliminary Report on Patentability received for PCT Patent Application No. PCT/US2015/023500, mailed on Oct. 13, 2016, 7 pages.
Ross et al., "Average Magnitude Difference Function Pitch Extractor", IEEE Transactions on Acoustics Speech and Signal Processing, vol. 22, No. 5, Oct. 1974, pp. 353-362.
First Examination Report received for Australian Patent Application No. 2015240992, mailed on Nov. 29, 2016, 2 pages.

* cited by examiner

SITUATION DEPENDENT TRANSIENT SUPPRESSION

BACKGROUND

In a typical audio or video call, especially one involving many participants, noise generated by non-speaking participants can contaminate the speaking participant's speech, thereby causing a distraction or even interrupting the conversation. An example scenario is where each participant on a conference call is using his or her own computer to connect to the call and is working on a task in parallel also using the computer (e.g., typing notes about the call). While embedded microphones, loudspeakers, and webcams in computers (e.g., laptop computers) have made conference calls very easy to set up, these features have also introduced specific noise nuisances such as feedback, fan noise, and button-clicking noise. Button-clicking noise, which is generally due to the mechanical impulses caused by keystrokes, can include annoying key clicks that all participants on the call can hear aside from the main conversation. In the context of laptop computers, for example, button-clicking noise can be a significant nuisance due to the mechanical connection between the microphone within the laptop case and the keyboard.

The impact that transient noises such as key clicks have on the overall user experience depends on the situation in which they occur. For example, in active voiced speech segments, key clicks mixed with the voice from the speaking participant are better masked and less detectable to other participants than during periods of silence or periods where only background noise is present. In these latter situations the key clicks are likely to be more noticeable to the participants and perceived as more of an annoyance or distraction.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to methods and systems for signal processing. More specifically, aspects of the present disclosure relate to performing different types or amounts of noise suppression on different types of audio segments (e.g., voiced speech segments, unvoiced segments, etc.), given detected transients and classified segments.

One embodiment of the present disclosure relates to a computer-implemented method for suppressing transient noise in an audio signal, the method comprising: estimating a voice probability for a segment of the audio signal containing transient noise, the estimated voice probability being a probability that the segment contains voice data; in response to determining that the estimated voice probability for the segment is greater than a threshold probability, performing a first type of suppression on the segment; and in response to determining that the estimated voice probability for the segment is less than the threshold probability, performing a second type of suppression on the segment, wherein the second type of suppression suppresses the transient noise contained in the segment to a different extent than the first type of suppression.

In another embodiment, the method for suppressing transient noise further comprises comparing the estimated voice probability for the segment to a threshold probability, and determining that the estimated voice probability is greater than the threshold probability based on the comparison.

In yet another embodiment, the method for suppressing transient noise further comprises comparing the estimated voice probability for the segment to a threshold probability, and determining that the estimated voice probability is less than the threshold probability based on the comparison.

In yet another embodiment, the method for suppressing transient noise further comprises receiving an estimated transient probability for the segment of the audio signal, the estimated transient probability being a probability that a transient noise is present in the segment, and determining that the segment of the audio signal contains transient noise based on the received estimated transient probability.

Another embodiment of the present disclosure relates to a system for suppressing transient noise in an audio signal, the system comprising at least one processor and a computer-readable medium coupled to the at least one processor having instructions stored thereon which, when executed by the at least one processor, causes the at least one processor to: estimate a voice probability for a segment of the audio signal containing transient noise, the estimated voice probability being a probability that the segment contains voice data; responsive to determining that the estimated voice probability for the segment is greater than a threshold probability, perform a first type of suppression on the segment; and responsive to determining that the estimated voice probability for the segment is less than the threshold probability, perform a second type of suppression on the segment, wherein the second type of suppression suppresses the transient noise contained in the segment to a different extent than the first type of suppression.

In another embodiment, the at least one processor in the system for suppressing transient noise is further caused to identify regions of the segment where the vocal folds are vibrating, and determine that the regions of the segment where the vocal folds are vibrating are regions containing voiced speech.

In still another embodiment, the at least one processor in the system for suppressing transient noise is further caused to compare the estimated voice probability for the segment to a threshold probability, and determine that the estimated voice probability is greater than the threshold probability based on the comparison.

In yet another embodiment, the at least one processor in the system for suppressing transient noise is further caused to compare the estimated voice probability for the segment to a threshold probability, and determine that the estimated voice probability is less than the threshold probability based on the comparison.

In another embodiment, the at least one processor in the system for suppressing transient noise is further caused to receive an estimated transient probability for the segment of the audio signal, the estimated transient probability being a probability that a transient noise is present in the segment; and determine that the segment of the audio signal contains transient noise based on the received estimated transient probability.

Yet another embodiment of the present disclosure relates to a computer-implemented method for suppressing transient noise in an audio signal, the method comprising: estimating a voice probability for a segment of the audio signal containing transient noise, the estimated voice probability being a probability that the segment contains voice data; in response to determining that the estimated voice probability for the segment corresponds to a first voice state, performing a first type of suppression on the segment; and in response to determining that the estimated voice probability for the segment corresponds to a second voice state, performing a second type of suppression on the segment, wherein the second type of suppression suppresses the transient noise contained in the segment to a different extent than the first type of suppression.

In still another embodiment, the method for suppressing transient noise further comprises, in response to determining that the estimated voice probability for the segment corresponds to a third voice state, performing a third type of suppression on the segment, wherein the third type of suppression suppresses the transient noise contained in the segment to a different extent than the first and second types of suppression.

In one or more other embodiments, the methods and systems described herein may optionally include one or more of the following additional features: the estimated voice probability is based on voicing information received from a pitch estimator; estimating the voice probability for the segment of the audio signal includes identifying regions of the segment containing voiced speech; identifying regions of the segment containing voiced speech includes identifying regions of the segment where the vocal folds are vibrating; the estimated voice probability for the segment of the audio signal is based on voice activity data received for the segment of the audio signal; the second type of suppression suppresses the transient noise contained in the segment to a greater extent than the first type of suppression; and/or the second type of suppression suppresses the transient noise contained in the segment to a lesser extent than the first type of suppression.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
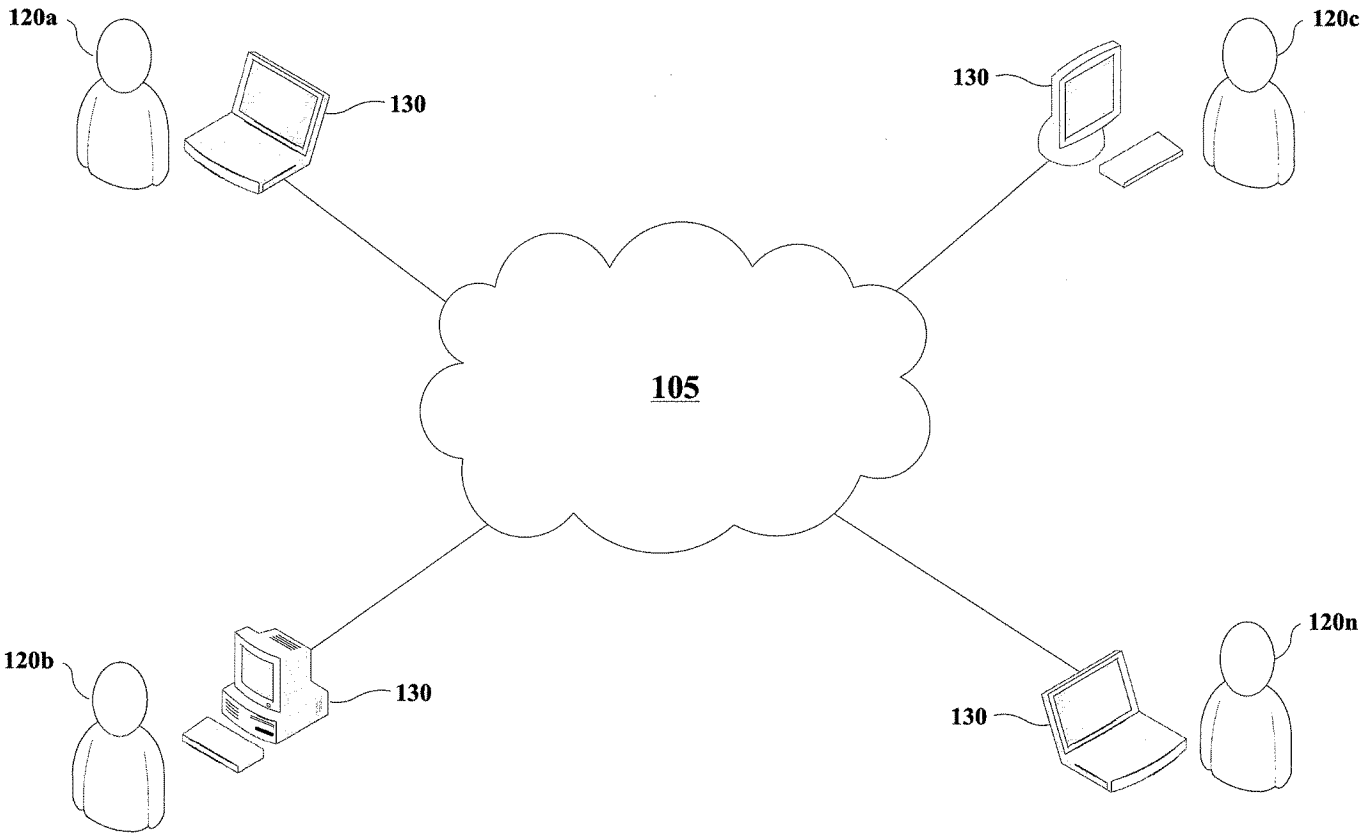
FIG. 1 is a schematic diagram illustrating an example application for situation dependent transient noise suppression according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include many other obvious features not described in detail herein. Additionally, some well-known structures or functions may not be shown or described in detail below, so as to avoid unnecessarily obscuring the relevant description.

In the context of existing noise suppression methodologies, there is generally a design trade-off made between suppression and speech distortion. For example, in at least some existing approaches higher suppression often comes at the price of distorting the speech signal from which the noise has been suppressed.

Embodiments of the present disclosure relate to methods and systems for providing situation dependent transient noise suppression for audio signals. In view of the deficiencies described above with respect to existing approaches for noise suppression of transient noises, the methods and systems of the present disclosure are designed to perform increased (e.g., a higher level of or a more aggressive strategy of) transient noise suppression and signal restoration in situations where there is little or no speech detected in a signal, and perform decreased (e.g., a lower level of or a less aggressive strategy of) transient noise suppression and signal restoration during voiced speech segments of the signal. As will be described in greater detail below, the methods and systems of the present disclosure utilize different types (e.g., amounts) of noise suppression during different types of audio segments (e.g., voiced speech segments, unvoiced segments, etc.), given detected transients and classified segments.

In accordance with one or more embodiments described herein, different kinds (e.g., types, amounts, etc.) of suppression may be applied to an audio signal associated with a user depending on whether or not the user is speaking (e.g., whether the signal associated with the user contains a voiced segment or an unvoiced/non-speech segment of audio). For example, in accordance with at least one embodiment, if a participant is not speaking or the signal associated with the participant contains an unvoiced/non-speech audio segment, a more aggressive strategy for transient suppression and signal restoration may be utilized for that participant's signal. On the other hand, where voiced audio is detected in the participant's signal (e.g., the participant is speaking), the methods and systems described herein may apply softer, less aggressive suppression and restoration.

Applying softer suppression and restoration to a signal containing voiced audio minimizes any distortion of the signal, thereby maintaining the intelligibility of the resultant speech generated from the signal. By applying different suppression and restoration schemes according to a "voice state" determined for each signal obviates the need to choose between suppressing all detected transients (and, as a result, distorting the speech contained in the signal) and not performing any suppression at all (and therefore avoiding distortion, but allowing the signal to contain transients). In accordance with one or more embodiments described herein, a voice state may be determined for a segment of audio based on, for example, a voice probability estimate generated for the segment, where the voice probability estimate is a probability that the segment contains voice data (e.g., speech).

One or more embodiments described herein relates to a noise suppression component configured to suppress detected transient noise, including key clicks, from an audio stream. For example, in accordance with at least one embodiment, the noise suppression is performed in the frequency domain and relies on a probability of the existence of a transient noise, which is assumed given. It should be understood that any of a variety of transient noise detectors known to those skilled in the art may be used for this purpose.

FIG. 1 illustrates an example application for situation dependent transient noise suppression in accordance with one or more embodiments of the present disclosure. For example, multiple users (e.g., participants, individuals, etc.) 120*a*, 120*b*, 120*c*, up through 120*n* (where "n" is an arbitrary number) may be participating in an audio/video communication session (e.g., an audio/video conference). The users 120 may be in communication with each over, for example, a wired or wireless connection or network 105, and each of the users 120 may be participating in the communication session using any of a variety of applicable user devices 130 (e.g., laptop computer, desktop computer, tablet computer, smartphone, etc.).

In accordance with at least one embodiment, one or more of the computing devices 130 being used to participate in the communication session may include a component or accessory that is a potential source of transient noise. For example, one or more of the computing devices 130 may have a keyboard or type pad that, if used by a participant 120 during the communication session, may generate transient noises that are detectable to the other participants (e.g., as audible key clicks or sounds).

Figure 2:
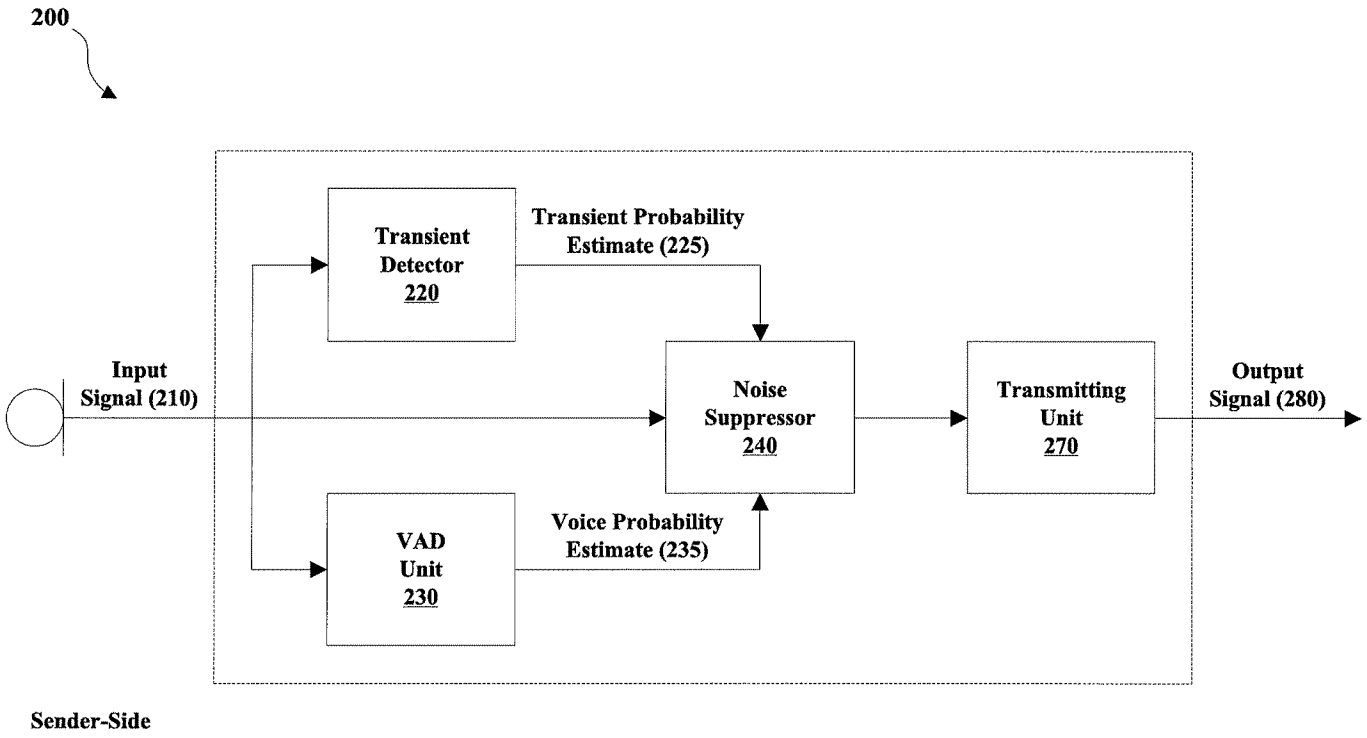
FIG. 2 is a block diagram illustrating an example system for situation dependent transient noise suppression according to one or more embodiments described herein.

FIG. 2 illustrates an example system for performing situation dependent transient suppression on an incoming audio signal based on a determined voice state of the signal according to one or more embodiments described herein. In accordance with at least one embodiment, the system 200 may operate at a sending-side endpoint of a communication path for a video/audio conference (e.g., at an endpoint associated with one or more of users 120 shown in FIG. 1), and may include a Transient Detector 220, a Voice Activity Detection (VAD) Unit 230, a Noise Suppressor 240, and a Transmitting Unit 270. Additionally, the system 200 may perform one or more algorithms similar to the algorithms illustrated in FIGS. 3-5, which are described in greater detail below.

An audio signal 210 input into the detection system 200 may be passed to the Transient Detector 220, the VAD Unit 230, and the Noise Suppressor 240. In accordance with at least one embodiment, the Transient Detector may be configured to detect the presence of a transient noise in the audio signal 210 using primarily or exclusively the incoming audio data associated with the signal. For example, the Transient Detector may utilize some time-frequency representation (e.g., discrete wavelet transform (DWT), wavelet packet transform (WPT), etc.) of the audio signal 210 as the basis in a predictive model to identify outlying transient noise events in the signal (e.g., by exploiting the contrast in spectral and temporal characteristics between transient noise pulses and speech signals). As a result, the Transient Detector may determine an estimated probability of transient noise being present in the signal 210, and send this transient probability estimate (225) to the Noise Suppressor 240.

The VAD Unit 230 may be configured to analyze the input signal 210 and, using any of a variety of techniques known to those skilled in the art, detect whether voice data is present in the signal 210. Based on its analysis of the signal 210, the VAD Unit 230 may send a voice probability estimate (235) to the Noise Suppressor 240.

The transient probability estimate (225) and the voice probability estimate (235) may be utilized by the Noise Suppressor 240 to determine which of a plurality of types of suppression/restoration to apply to the signal 210. As will be described in greater detail herein, the Noise Suppressor 240 may perform "hard" or "soft" restoration on the audio signal 210, depending on whether or not the signal contains voice audio (e.g., speech data).

It should be noted that, in accordance with one or more other embodiments of the present disclosure, the system 200 may operate at other points in the communication path between participants in a video/audio conference in addition to or instead of the sender-side endpoint described above. For example, the system 200 may perform situation dependent transient suppression on a signal received for playout at a receiver endpoint of the communication path.

Figure 3:
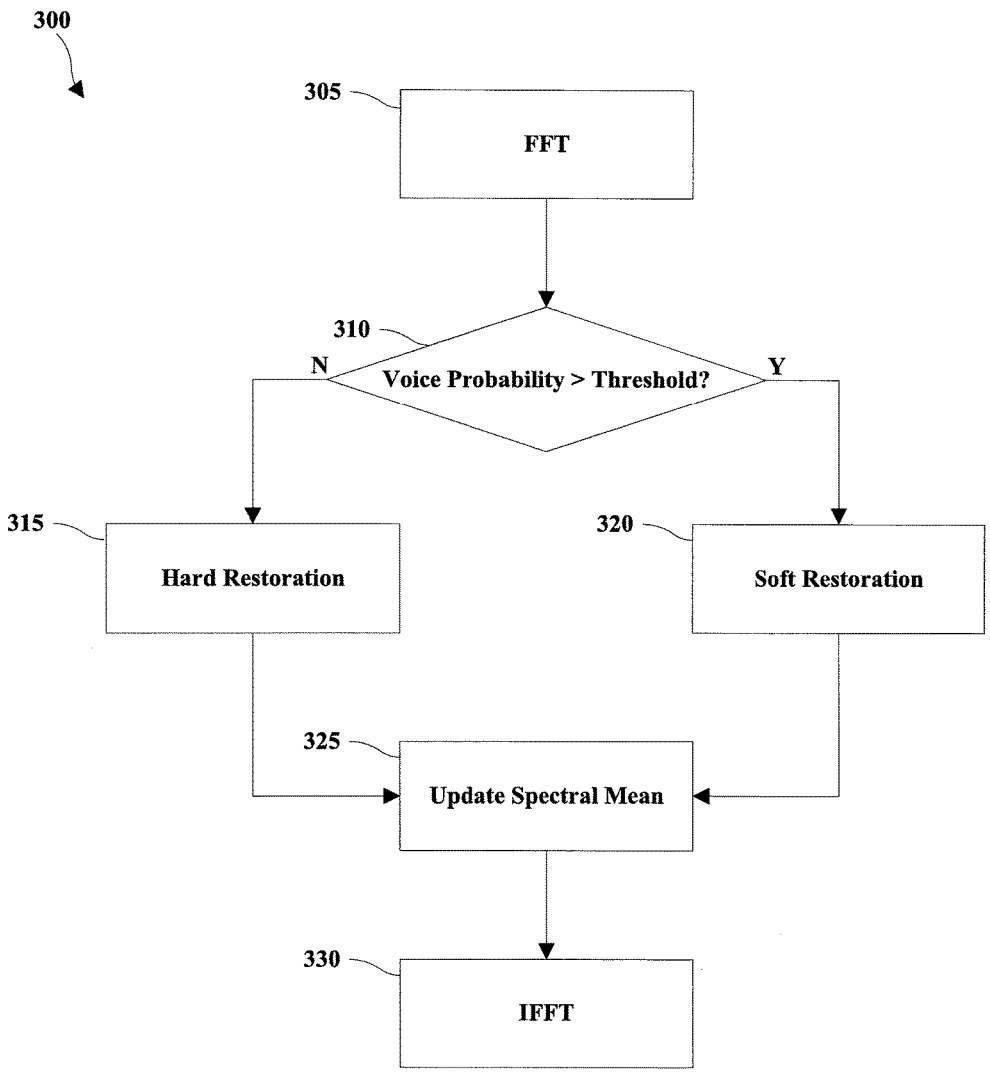
FIG. 3 is a flowchart illustrating an example method for transient noise suppression and restoration of an audio signal according to one or more embodiments described herein.

FIG. 3 illustrates an example process for transient noise suppression and restoration of an audio signal in accordance with one or more embodiments described herein. In accordance with at least one embodiment, the example process 300 may be performed by one or more of the components in the example system for situation dependent transient suppression 200, described in detail above and illustrated in FIG. 2.

As shown, the process 300 applies different suppression strategies (e.g., blocks 315 and 320) depending on whether a segment of audio is determined to be a voiced or an unvoiced/non-speech segment. For example, after applying a Fast Fourier Transform (FFT) to a segment of an audio signal at block 305 to transform the segment to the frequency domain, a determination may be made at block 310 as to whether a voice probability associated with the segment is greater than a threshold probability. For example, the threshold probability may be a predetermined fixed probability. In accordance with at least one embodiment, the voice probability associated with the audio segment is based on voice information generated outside of, and/or in advance of, the example process 300. For example, the voice probability utilized at block 310 may be based on voice information received from, for example, a voice activity detection unit (e.g., VAD Unit 230 in the example system 200 shown in FIG. 2). In another example, the voice probability associated with the segment may be based on information about voicing within speech sounds received, for example, from a pitch estimation algorithm or pitch estimator. For example, the information about voicing within speech sounds received from the pitch estimator may be used to identify regions of the audio segment where the vocal folds are vibrating.

If it is determined at block 310 that the voice probability associated with the audio segment is greater than the threshold probability, then at block 320 the segment is processed through "soft" restoration (e.g., less aggressive suppression as compared to the "hard" restoration at block 315). On the other hand, if it is determined at block 310 that the voice probability associated with the audio segment is equal to or less than the threshold probability, then at block 315 the segment is processed through "hard" restoration (e.g., more aggressive suppression as compared to the "soft" restoration at block 320).

Performing hard or soft restoration (at blocks 315 and 320, respectively) based on a comparison of the voice probability associated with the segment to a threshold probability (at block 310) allows for more aggressive suppression processing of unvoiced/non-speech blocks of audio and more conservative suppression processing of audio blocks containing voiced sounds. In accordance with at least one embodiment of the present disclosure, the operations performed at block 315 (for hard restoration) may correspond to the operations performed at block 405 in the example process 400, illustrated in FIG. 4 and described in greater detail below. Similarly, the operations performed at block 320 (for soft restoration) may correspond to the operations performed at block 510 in the example process 500, illustrated in FIG. 5 and also described in greater detail below.

Following either of the suppression/restoration processes at blocks 315 and 320, at block 325 the spectral mean may be updated for the audio segment. At block 330, the signal may undergo inverse FFT (IFFT) to be transformed back into the time domain.

Figure 4:
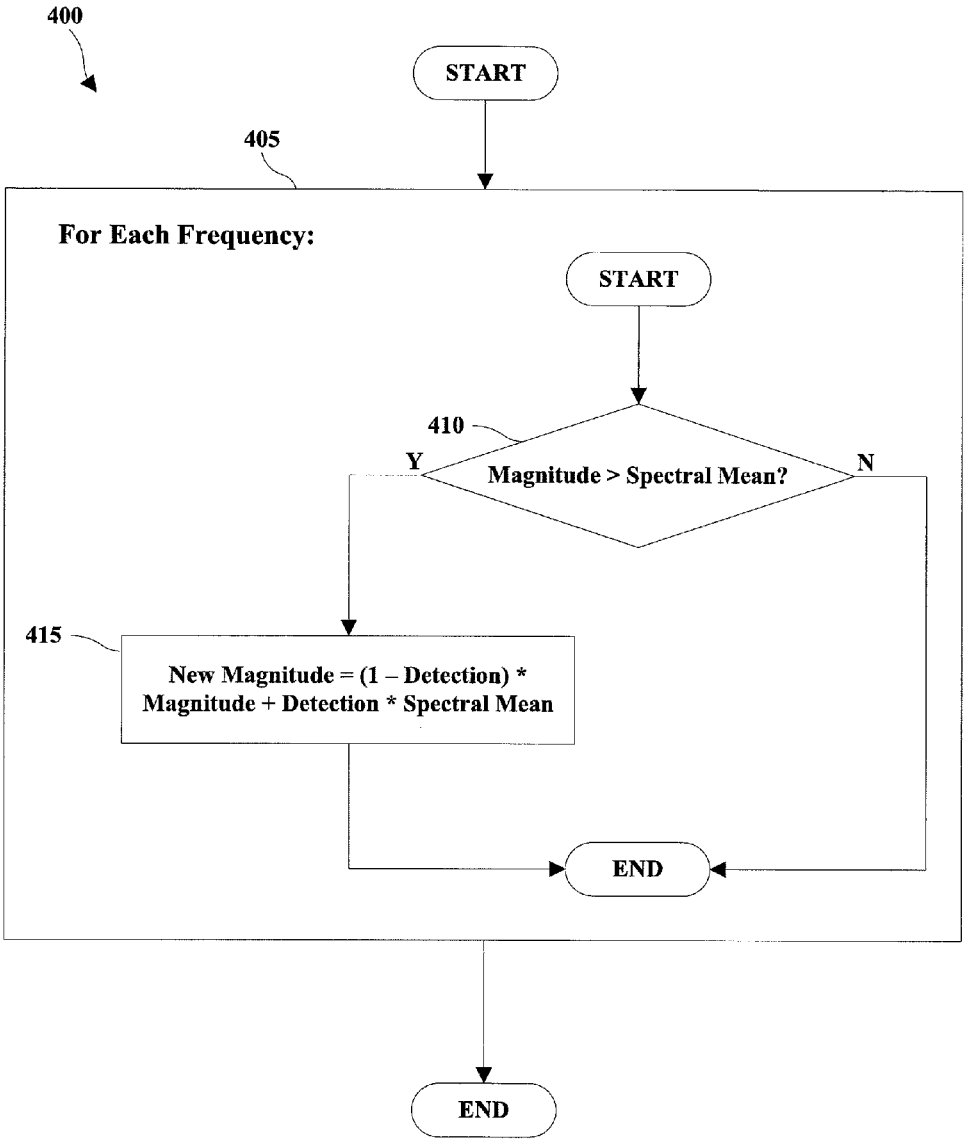
FIG. 4 is a flowchart illustrating an example method for restoration of an audio signal based on a determination that the audio signal contains unvoiced/non-speech audio data according to one or more embodiments described herein.

FIG. 4 illustrates an example process for hard restoration of an audio signal based on a determination that the audio signal contains unvoiced/non-speech audio data. For example, the hard restoration process 400 may be performed based on an audio signal having a first voice state (e.g., of a plurality of possible voice states corresponding to different probabilities of the signal containing voice data), where the first voice state corresponds to a voice probability estimate associated with the signal being low (indicating that there is a high probability of the signal containing unvoiced/non-speech data), a second voice state corresponds to a voice probability estimate that is higher than the probability estimate corresponding to the first voice state, and so on. In accordance with one or more embodiments described herein, the example process 400 may be performed by one or more of the components (e.g., Noise Suppressor 240) in the example system for situation dependent transient suppression 200, described in detail above and illustrated in FIG. 2. It should be understood that, in accordance with at least one embodiment, the voice states may correspond to the voice probability estimates in one or more other ways in addition to or instead of the example correspondence presented above.

Furthermore, in accordance with at least one embodiment of the present disclosure, the operations performed at block 405 (which include blocks 410 and 415) in the example process 400 may correspond to the operations performed at block 315 in the example process 300 described above and illustrated in FIG. 3.

It should be noted that in performing process 400, it may be necessary to keep track of the spectral mean to suppress the detected transients and restore the original audio signal. It should also be noted that, in accordance with at least one embodiment, the operations comprising block 405 may be performed in an iterative manner for each frequency bin. For example, at block 410, the magnitude for a given frequency bin may be compared to the (tracked) spectral mean.

If it is determined at block 410 that the magnitude is greater than the spectral mean, it is suppressed and new magnitude is calculated at block 415. On the other hand, if it is determined at block 410 that the magnitude is not greater than the spectral mean (e.g., is equal to or less than the spectral mean), no suppression is performed and the operations of block 405 may be repeated for the next frequency.

If suppression is performed as a result of the determination made at block 410, a new magnitude may be calculated at block 415. In accordance with at least one embodiment, the new magnitude calculated at block 415 may be a linear combination of the previous magnitude and the spectral mean, depending on the detection probability (e.g., the transient probability estimate (225) received at Noise Suppressor 240 from the Transient Detector 220 in the example system 200 shown in FIG. 2). For example, the new magnitude may be calculated as follows:

$$\text{New Magnitude}=(1-\text{Detection})*\text{Magnitude}+\text{Detection}*\text{Spectral Mean}$$

Where "Detection" corresponds to the estimated probability that a transient is present and "Magnitude" corresponds to the previous magnitude (e.g., the magnitude compared at block 410). Given the above calculation, if it is determined that a transient is present (e.g., based on the estimated probability), the new magnitude is the spectral mean. However, if the transient probability estimate indicates that no transients are present in the block, no suppression takes place.

Figure 5:
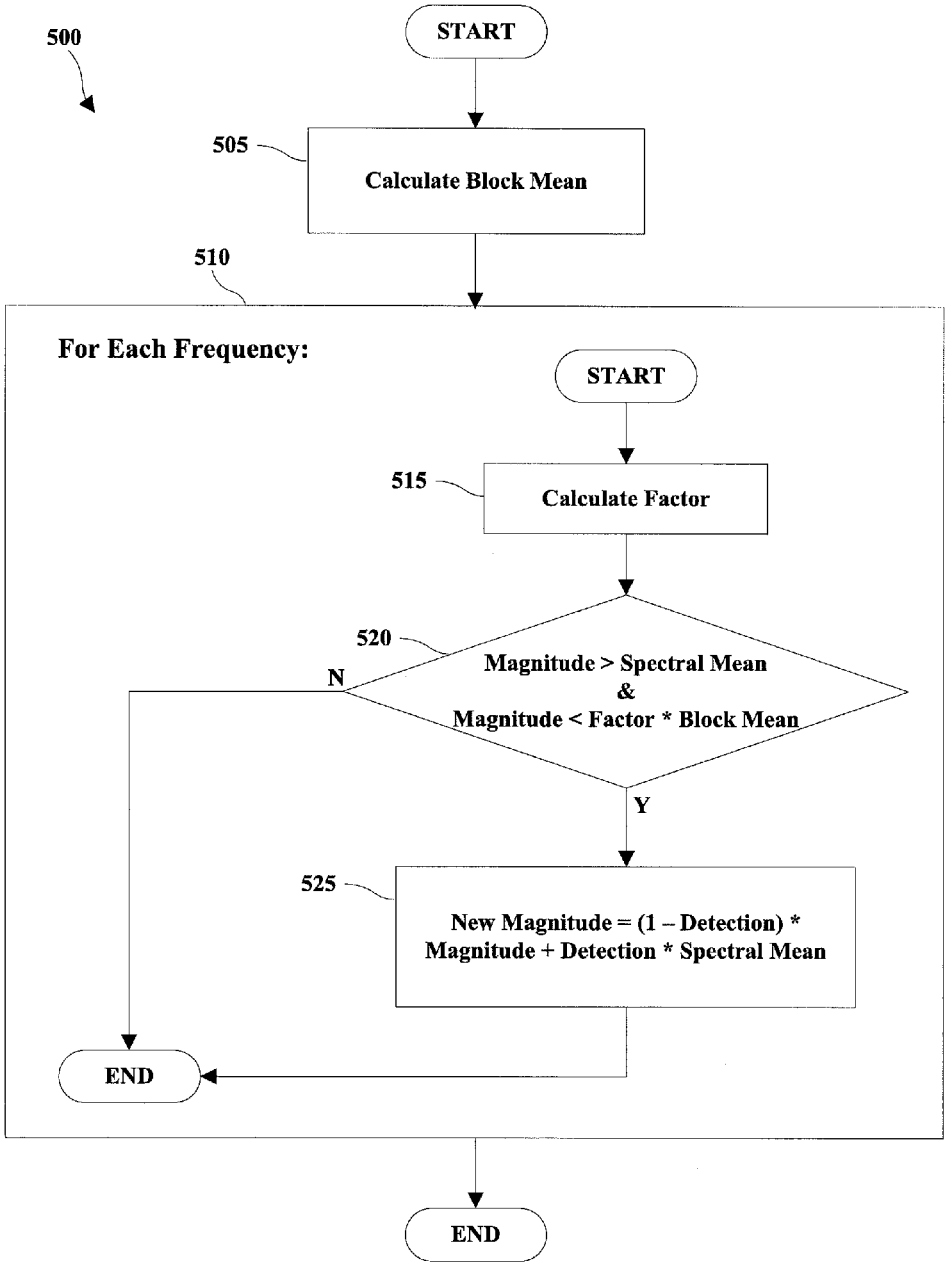
FIG. 5 is a flowchart illustrating an example method for restoration of an audio signal based on a determination that the audio signal contains voice data according to one or more embodiments described herein.

FIG. 5 illustrates an example process for soft restoration of an audio signal based on a determination that the audio signal contains voice data. For example, the soft restoration process 500 may be performed based on an audio signal having a second voice state, where the second voice state corresponds to a voice probability estimate that is higher than the voice probability estimate corresponding to the first voice state, as described above with respect to the example process 400 shown in FIG. 4. In accordance with one or more embodiments described herein, the example process 500 may be performed by one or more of the components (e.g., Noise Suppressor 240) in the example system for situation dependent transient suppression 200, described in detail above and illustrated in FIG. 2.

Furthermore, in accordance with at least one embodiment of the present disclosure, the operations performed at block 510 (which include blocks 515, 520, and 525) in the example process 500 may correspond to the operations performed at block 320 in the example process 300 described above and illustrated in FIG. 3.

As with the example process (e.g., process 400) for hard restoration described above, it should be noted that in performing process 500 the spectral mean for the block of audio may be calculated at block 505. It should also be noted that, in accordance with at least one embodiment, the operations comprising block 510 may be performed in an iterative manner for each frequency bin.

At block 515, for a given frequency bin, a factor of the block mean (determined at block 505) may be calculated. In accordance with at least one embodiment, the factor of the block mean may be a fixed spectral weighting, de-emphasizing typical speech spectral frequencies. For example, the factor of the block mean determined at block 515 may be the mean value over the current block spectrum. The factor calculated at block 515 may have continuous values (e.g., between 1 and 5), which are lower for speech frequencies (e.g., 300 Hz to 3500 Hz).

At block 520, the magnitude for the frequency may be compared to the calculated spectral mean and also compared to the factor of the block mean calculated at block 515. For example, at block 520, it may be determined whether the magnitude is both greater than the spectral mean and less than the factor of the block mean. Determining whether such a condition is satisfied at block 520 makes it possible to maintain voice harmonics while suppressing the transient noise between the harmonics.

If it is determined at block 520 that the magnitude is both greater than the spectral mean and less than the factor of the block mean, then suppression is performed and the operations continue at block 525 where a new magnitude may be calculated. On the other hand, if it is determined at block 520 that the magnitude is not greater than the spectral mean (e.g., is equal to or less than the spectral mean), the magnitude is not less than the factor of the block mean (e.g., is equal to or greater than the factor of the block mean), or both, then no suppression is performed and the operations of block 510 may be repeated for the next frequency.

If suppression is performed as a result of the determination made at block 520, a new magnitude may be calculated at block 525. In accordance with at least one embodiment, the new magnitude calculated at block 525 may be calculated in a similar manner as the new magnitude calculation performed at block 415 of the example process 400 (described above and illustrated in FIG. 4). For example, the new magnitude calculated at block 525 may be a linear combination of the previous magnitude and the spectral mean, depending on the detection probability (e.g., the transient probability estimate (225) received at Noise Suppressor 240 from the Transient Detector 220 in the example system 200 shown in FIG. 2). For example, the new magnitude may be calculated at block 525 as follows:

$$\text{New Magnitude}=(1-\text{Detection})*\text{Magnitude}+\text{Detection}*\text{Spectral Mean}$$

Where "Detection" corresponds to the estimated probability that a transient is present and "Magnitude" corresponds to the previous magnitude (e.g., the magnitude compared at block 520). Given the above calculation, if it is determined that a transient is present (e.g., based on the estimated probability), the new magnitude is the spectral mean. However, if the transient probability estimate indicates that no transients are present in the block, no suppression takes place.

Figure 6:
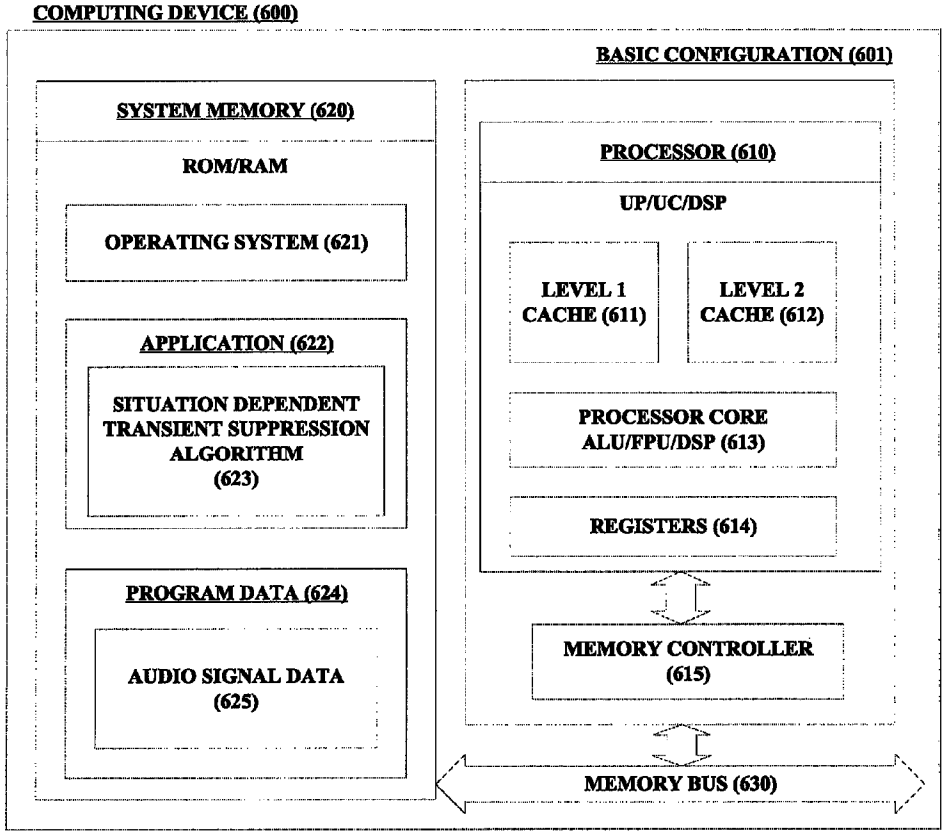
FIG. 6 is a block diagram illustrating an example computing device arranged for situation-dependent transient noise suppression according to one or more embodiments described herein.

FIG. 6 is a high-level block diagram of an exemplary computer (600) arranged for situation dependent transient noise suppression according to one or more embodiments described herein. In a very basic configuration (601), the computing device (600) typically includes one or more processors (610) and system memory (620). A memory bus (630) can be used for communicating between the processor (610) and the system memory (620).

Depending on the desired configuration, the processor (610) can be of any type including but not limited to a microprocessor (μP), a microcontroller (μC), a digital signal processor (DSP), or any combination thereof. The processor (610) can include one more levels of caching, such as a level one cache (611) and a level two cache (612), a processor core (613), and registers (614). The processor core (613) can include an arithmetic logic unit (ALU), a floating point unit (FPU), a digital signal processing core (DSP Core), or any combination thereof. A memory controller (616) can also be used with the processor (610), or in some implementations the memory controller (615) can be an internal part of the processor (610).

Depending on the desired configuration, the system memory (620) can be of any type including but not limited to volatile memory (such as RAM), non-volatile memory (such as ROM, flash memory, etc.) or any combination thereof. System memory (620) typically includes an operating system (621), one or more applications (622), and program data (624). The application (622) may include a situation dependent transient suppression algorithm (623) for applying different kinds (e.g., types, amounts, levels, etc.) of suppression/restoration to an audio signal based on a determination as to whether or not the signal contains voice data. In accordance with at least one embodiment, the situation dependent transient suppression algorithm (623) may operate to perform more/less aggressive suppression/restoration on an audio signal associated with a user depending on whether or not the user is speaking (e.g., whether the signal associated with the user contains a voiced segment or an unvoiced/non-speech segment of audio). For example, in accordance with at least one embodiment, if a participant is not speaking or the signal associated with the participant contains an unvoiced/non-speech audio segment, the situation dependent transient suppression algorithm (623) may apply a more aggressive strategy for transient suppression and signal restoration for that participant's signal. On the other hand, where voiced audio is detected in the participant's signal (e.g., the participant is speaking), the situation dependent transient suppression algorithm (623) may apply softer, less aggressive suppression and restoration.

Program data (624) may include storing instructions that, when executed by the one or more processing devices, implement a method for situation dependent transient noise suppression and restoration of an audio signal according to one or more embodiments described herein. Additionally, in accordance with at least one embodiment, program data (624) may include audio signal data (625), which may include data about a probability of an audio signal containing voice data, data about a probability of transient noise being present in the signal, or both. In some embodiments, the application (622) can be arranged to operate with program data (624) on an operating system (621).

The computing device (600) can have additional features or functionality, and additional interfaces to facilitate communications between the basic configuration (601) and any required devices and interfaces.

System memory (620) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 600. Any such computer storage media can be part of the device (600).

The computing device (600) can be implemented as a portion of a small-form factor portable (or mobile) electronic device such as a cell phone, a smart phone, a personal data assistant (PDA), a personal media player device, a tablet computer (tablet), a wireless web-watch device, a personal headset device, an application-specific device, or a hybrid device that include any of the above functions. The computing device (600) can also be implemented as a personal computer including both laptop computer and non-laptop computer configurations.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and or firmware would be well within the skill of one of skill in the art in light of this disclosure.

In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium. (e.g., a fiber optic cable, a waveguide, a wired communications link, a wireless communication link, etc.).

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A method performed by a teleconference computing device for suppressing transient noise in an audio signal, the method comprising:

estimating a voice probability for a segment of the audio signal containing transient noise, the estimated voice probability being a probability that the segment contains voice data;

responsive to determining that the estimated voice probability for the segment is greater than a threshold probability, suppressing the transient noise contained in the segment of the audio signal while reducing distortion of the voice data, including:

calculating a spectral mean for the audio segment over a plurality of frequency bins of the audio segment, and for each frequency bin of the plurality of frequency bins of the audio segment, if a comparison of a current value of the magnitude of the frequency bin to the spectral mean and to a calculated factor of the spectral mean indicates that transient noise is present, suppressing the transient noise in the frequency bin, wherein the calculated factor of the spectral mean is a fixed spectral weighting that is configured to de-emphasize frequency bins of the plurality of frequency bins corresponding to frequencies at which the voice data is transmitted, wherein suppressing the transient noise includes adjusting the magnitude of the frequency bin to a new value between the spectral mean and the current value of the magnitude of the frequency bin; and responsive to determining that the estimated voice probability for the segment is less than the threshold probability, suppressing the transient noise contained in the segment of the audio signal while not reducing distortion of the voice data, including:

calculating a spectral mean for the audio segment over the plurality of frequency bins of the audio segment, and for each frequency bin of the plurality of frequency bins of the audio segment, if a comparison of a magnitude of the frequency bin to the spectral mean indicates that transient noise is present, suppressing the transient noise in the frequency bin, wherein suppressing the transient noise includes adjusting the magnitude of the frequency bin to a new value between the spectral mean and the current value of the magnitude of the frequency bin, wherein the transient noise is at least one of feedback noise, fan noise, and button-clicking noise due to mechanical connection between an audio capture device and a keyboard or trackpad of the teleconferencing computing device.

2. The method of claim 1, wherein the estimated voice probability is based on voicing information received from a pitch estimator.

3. The method of claim 1, wherein estimating the voice probability for the segment of the audio signal includes identifying regions of the segment containing voiced speech.

4. The method of claim 3, wherein identifying regions of the segment containing voiced speech includes identifying regions of the segment where the vocal folds are vibrating.

5. The method of claim 1 further comprising:

in response to the comparison of the magnitude of the frequency bin to the spectral mean and to the calculated factor of the spectral mean satisfying a first condition, calculating a new magnitude for the frequency bin; and in response to the comparison of the magnitude of the frequency bin to the spectral mean and to the calculated factor of the spectral mean satisfying a second condition, maintaining the magnitude for the frequency bin, wherein the first condition is different from the second condition.

6. The method of claim 1 further comprising:

in response to the comparison of the magnitude of the frequency bin to the spectral mean satisfying a first condition, calculating a new magnitude for the frequency bin; and in response to the comparison of the magnitude of the frequency bin to the spectral mean satisfying a second condition, maintaining the magnitude for the frequency bin, wherein the first condition is different from the second condition.

7. The method of claim 5, wherein the new magnitude for the frequency bin is calculated based on the previous magnitude, the spectral mean, and an estimated probability that a transient noise is present in the audio segment.

8. The method of claim 6, wherein the new magnitude for the frequency bin is calculated based on the previous magnitude, the spectral mean, and an estimated probability that a transient noise is present in the audio segment.

9. A teleconferencing computing system for suppressing transient noise in an audio signal, the system comprising:

at least one processor; and a non-transitory computer-readable medium coupled to the at least one processor having instructions stored thereon which, when executed by the at least one processor, causes the at least one processor to:

estimate a voice probability for a segment of the audio signal containing transient noise, the estimated voice probability being a probability that the segment contains voice data;

responsive to determining that the estimated voice probability for the segment is greater than a threshold probability, suppress the transient noise contained in the segment of the audio signal while reducing distortion of the voice data, including:

calculating a spectral mean for the audio segment over a plurality of frequency bins of the audio segment, and for each frequency bin of the plurality of frequency bins of the audio segment, if a comparison of a current value of the magnitude of the frequency bin to the spectral mean and to a calculated factor of the spectral mean indicates that transient noise is present, suppressing the transient noise in the frequency bin, wherein the calculated factor of the spectral mean is a fixed spectral weighting that is configured to de-emphasize frequency bins of the plurality of frequency bins corresponding to frequencies at which the voice data is transmitted, wherein suppressing the transient noise includes adjusting the magnitude of the frequency bin to a new value between the spectral mean and the current value of the magnitude of the frequency bin; and responsive to determining that the estimated voice probability for the segment is less than the threshold probability, suppress the transient noise contained in the segment of the audio signal while not reducing distortion of the voice data, including:

calculating a spectral mean for the audio segment over a plurality of frequency bins of the audio segment, and for each frequency bin of the plurality of frequency bins of the audio segment, if a comparison of a magnitude of the frequency bin to the spectral mean indicates that transient noise is present, suppress the transient noise in the frequency bin, wherein suppressing the transient noise includes adjusting the magnitude of the frequency bin to a new value between the spectral mean and the current value of the magnitude of the frequency bin, wherein the transient noise is at least one of feedback noise, fan noise, and button-clicking noise due to mechanical connection between an audio capture device and a keyboard or trackpad of the teleconferencing computing device.

10. The system of claim 9, the estimated voice probability is based on voicing information received from a pitch estimator.

11. The system of claim 9, wherein the at least one processor is further caused to:

identify regions of the segment where the vocal folds are vibrating; and determine that the regions of the segment where the vocal folds are vibrating are regions containing voiced speech.

12. The system of claim 9, wherein the at least one processor is further caused to:

in response to the comparison of the magnitude of the frequency bin to the spectral mean and to the calculated factor of the spectral mean satisfying a first condition, calculate a new magnitude for the frequency bin; and in response to the comparison of the magnitude of the frequency bin to the spectral mean and to the calculated factor of the spectral mean satisfying a second condition, maintain the magnitude for the frequency bin, wherein the first condition is different from the second condition.

13. The system of claim 9, wherein the at least one processor is further caused to:

in response to the comparison of the magnitude of the frequency bin to the spectral mean satisfying a first condition, calculate a new magnitude for the frequency bin; and in response to the comparison of the magnitude of the frequency bin to the spectral mean satisfying a second condition, maintain the magnitude for the frequency bin, wherein the first condition is different from the second condition.

14. The system of claim 12, wherein the at least one processor is further caused to:

calculate the new magnitude for the frequency bin based on the previous magnitude, the spectral mean, and an estimated probability that a transient noise is present in the audio segment.

15. The system of claim 13, wherein the at least one processor is further caused to:

calculate the new magnitude for the frequency bin based on the previous magnitude, the spectral mean, and an estimated probability that a transient noise is present in the audio segment.

16. A method performed by a teleconference computing device for suppressing transient noise in an audio signal, the method comprising:

estimating a voice probability for a segment of the audio signal containing transient noise, the estimated voice probability being a probability that the segment contains voice data;

responsive to determining that the estimated voice probability for the segment is greater than a threshold probability, suppressing the transient noise contained in the segment of the audio signal while reducing distortion of the voice data, including:

calculating a spectral mean for the audio segment over a plurality of frequency bins of the audio segment, and for each frequency bin of the plurality of frequency bins of the audio segment, if a comparison of a current value of the magnitude of the frequency bin to the spectral mean and to a calculated factor of the spectral mean indicates that transient noise is present, suppressing the transient noise in the frequency bin, wherein the calculated factor of the spectral mean is a fixed spectral weighting that is configured to de-emphasize frequency bins of the plurality of frequency bins corresponding to frequencies at which the voice data is transmitted, wherein suppressing the transient noise includes adjusting the magnitude of the frequency bin to a new value between the spectral mean and the current value of the magnitude of the frequency bin; and responsive to determining that the estimated voice probability for the segment is less than the threshold probability, suppressing the transient noise contained in the segment of the audio signal while not reducing distortion of the voice data, including:

calculating a spectral mean for the audio segment over the plurality of frequency bins of the audio segment, and for each frequency bin of the plurality of frequency bins of the audio segment, if a comparison of a magnitude of the frequency bin to the spectral mean indicates that transient noise is present, suppressing the transient noise in the frequency bin, wherein suppressing the transient noise includes adjusting the magnitude of the frequency bin to a new value between the spectral mean and the current value of the magnitude of the frequency bin, wherein the transient noise is at least one of feedback noise, fan noise, and button-clicking noise due to mechanical connection between an audio capture device and a keyboard or trackpad of the teleconferencing computing device.

17. The method of claim 16, further comprising:

in response to the comparison of the magnitude of the frequency bin to the spectral mean and to the calculated factor of the spectral mean satisfying a first condition, calculating a new magnitude for the frequency bin; and in response to the comparison of the magnitude of the frequency bin to the spectral mean and to the calculated factor of the spectral mean satisfying a second condition, maintaining the magnitude for the frequency bin, wherein the first condition is different from the second condition.

18. The method of claim 16, further comprising:

in response to the comparison of the magnitude of the frequency bin to the spectral mean satisfying a first condition, calculating a new magnitude for the frequency bin; and in response to the comparison of the magnitude of the frequency bin to the spectral mean satisfying a second condition, maintaining the magnitude for the frequency bin, wherein the first condition is different from the second condition.

* * * * *